United States Patent [19]

Dohanyos

[11] 4,106,315

[45] Aug. 15, 1978

[54] SHIELDED LOCK ASSEMBLY

[76] Inventor: John A. Dohanyos, 2711 Vestry Ave., Cleveland, Ohio 44113

[21] Appl. No.: 759,576

[22] Filed: Jan. 14, 1977

[51] Int. Cl.[2] ..... E05B 67/38

[52] U.S. Cl. ..... 70/56; 70/417; 292/281

[58] Field of Search ..... 70/54, 55, 56, 417, 70/63, 18; 292/281

[56] References Cited

U.S. PATENT DOCUMENTS 3,590,607 7/1971 Beaver ..... 70/56

*Primary Examiner*—Robert L. Wolfe

*Attorney, Agent, or Firm*—Fay & Sharpe

[57] ABSTRACT

A shielded lock assembly incorporating a housing surrounding a shackle and lock body. The housing renders more difficult access to the shackle and lock body in order to reduce the incidence of theft involving the prying, cutting or other destruction of the shackle or lock body. In one embodiment of the invention the shielded lock assembly is adapted to receive a pair of cable ends. In a modified embodiment of the invention the lock assembly is adapted to be positioned adjacent a planar surface such as defined by a pair of doors or the like. In a still further modified form of the invention, the lock assembly is adapted to be positioned adjacent intersecting planar surfaces such as defined by a door and a jamb.

6 Claims, 15 Drawing Figures

FIG. 1
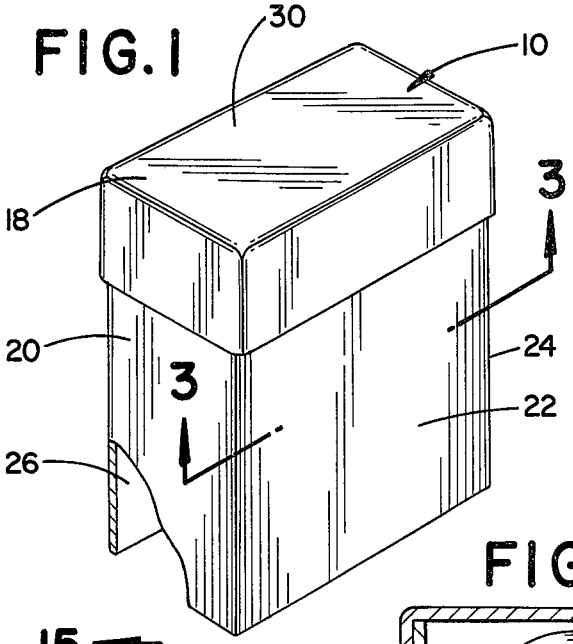
FIG. 3
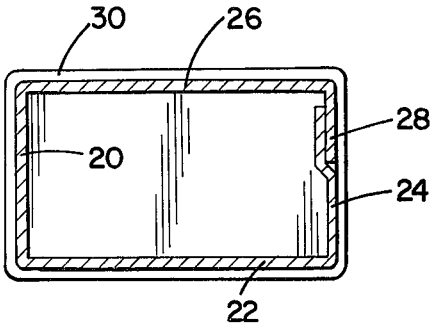
FIG. 2
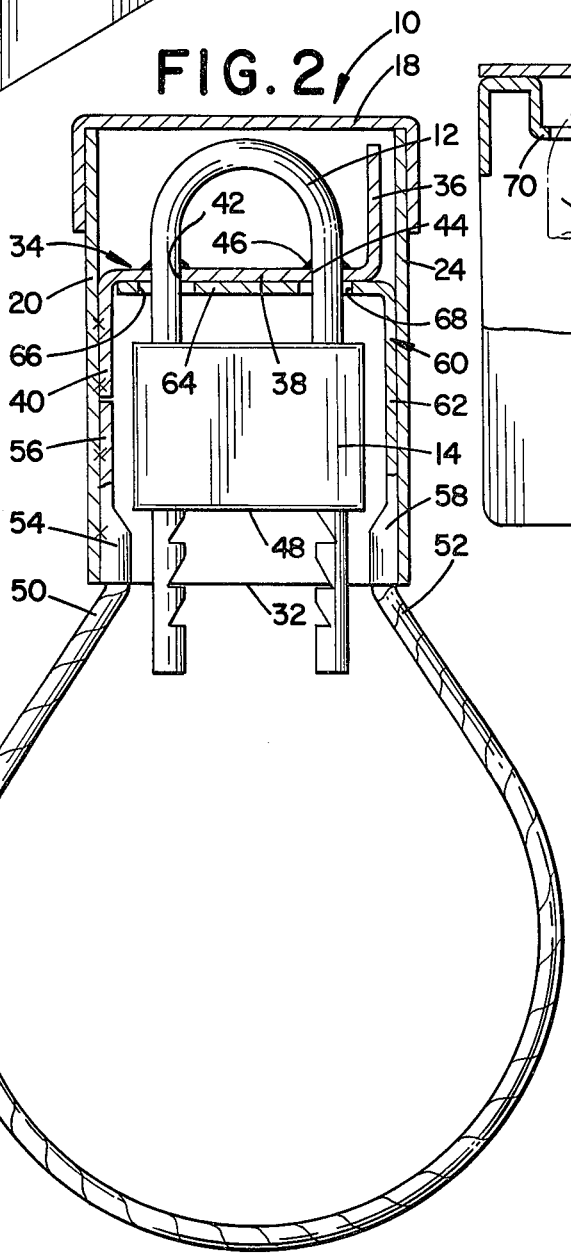
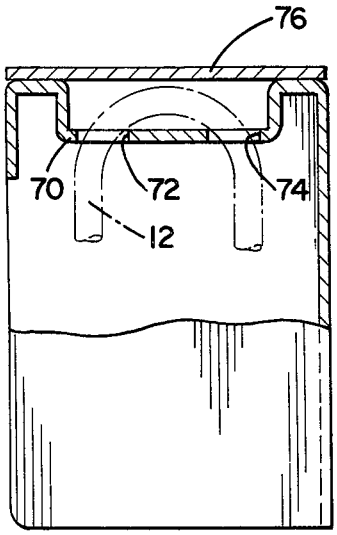
FIG. 15
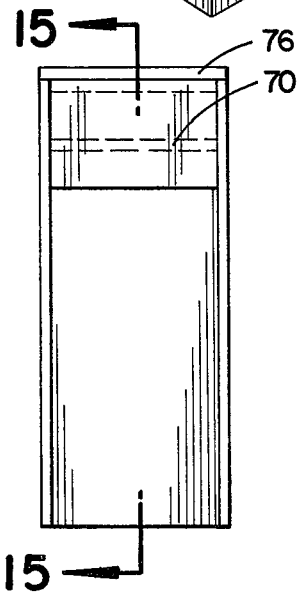
FIG. 14

SHIELDED LOCK ASSEMBLY

BACKGROUND OF THE INVENTION

This invention is directed to a shielded lock assembly. More particularly this invention contemplates the use of a housing surrounding a padlock for the purpose of rendering more difficult the destructive access to such padlock.

Conventional padlock generally comprise a lock body which cooperates with a shackle. The shackle is adapted to cooperate with a locking staple or hasp in order to provide for the locking of a door, window, cabinet, box or the like. Due to their construction, padlocks are particularly vulnerable to prying or cutting tools. It is not an uncommon experience for a property owner to discover that his padlock shackle has been cut with a bolt cutter or chisel or to find that the lock body of the padlock has been pried from the shackle.

Numerous attempts have been made to render padlocks more resistant to thievery. As an example, hardened steel shackles and hardened steel lock body casings have been employed in order to render more difficult the cutting or severing of the shackle or lock body. The use of such special materials, however, not only increases the cost of the padlock but in some cases is not totally effective as, given enough time, a thief can open virtually any exposed padlock.

This invention contemplates the use of a housing or enclosure surrounding a padlock for the purpose of shielding the padlock from attack by a thief using cutting tools. The housing or enclosure is adapted to closely surround the padlock body and shackle in a manner that only the key cylinder of the padlock is exposed.

Applicant's invention, therefore, contemplates the use of standard commercially available padlocks which are incorporated with applicant's novel elements producing a lock assembly of superior theft resistance.

Applicant cautions that his lock assembly is not absolutely immune to unauthorized entry. Indeed no such claim can be made with respect to any lock assembly since given sufficient time and proper tools and equipment any type of lock assembly can be penetrated. However, in shielding or hiding the padlock from access by an unauthorized person applicant's lock assembly serves to retard if not discourage entirely an attempt to gain unauthorized access to property protected by applicant's lock assembly.

SUMMARY OF THE INVENTION

Briefly summarized applicant's invention comprises a housing which closely surrounds a shackle and lock body. A shackle hanger is supported interiorly of the housing and serves to hold and retain the shackle within the housing.

In the preferred embodiment of the invention the housing defines a closed generally cup shaped member with an access opening near the bottom thereof. A pair of cable ends are adapted to be disposed within the housing. One of the cable ends is attached to an interior wall of the housing. The other cable end is attached to an L-shaped locking element which is adapted to cooperate with the shackle and lock body in order to retain the cable and the housing.

In a modification of the invention applicant's housing is provided with a pair of side walls, an outer wall and an upper wall. The housing is adapted to be positioned adjacent a planar surface such that the housing side walls, outer wall and upper wall cooperate with the planar surface to define a closed generally cup shaped enclosure with an access opening near the bottom of the enclosure. A pair of locking staples extend from the planar surface into the enclosure and are adapted to be fixed, one relative to the other, by means of the shackle and lock body. The upper wall of the housing is provided with a locking flange adapted to cooperate with a complementary locking flange defined by one of the locking staples for the purpose of securing the upper portion of the housing in engagement with the planar surface so as to render more difficult the removal of the housing away from the planar surface.

In a still further modification of the invention applicant's housing is provided with a single side wall, an outer wall and an upper wall. The housing is adapted to be positioned adjacent a pair of planar surfaces which are positioned approximately 90° to each other such that the side wall, outer wall and upper wall cooperate with the planar surfaces to define a closed generally cup shaped enclosure with an access opening near the bottom of the enclosure. A pair of locking staples extend from one of the planar surfaces into the enclosure. The other of the planar surfaces is provided with a locking element which is adapted to cooperate with a locking flange defined at the upper wall of the housing.

BRIEF DESCRIPTION OF THE DRAWING

Applicant's invention will be described with reference to the accompanying drawings in which:

FIG. 1 is an elevational view, partly in section, and showing the housing of the preferred embodiment of applicant's invention shown in FIG. 2;

FIG. 2 is a front elevational view, partly in section, and showing the cable lock embodiment of applicant's invention;

FIG. 3 is a cross-sectional view taken along the line 3—3 of FIG. 1;

FIG. 14 is a side elevational view, partly in phantom, and showing a modified form of shackle hanger; and FIG. 15 is a cross-sectional view taken along the line 15—15 of FIG. 14.

DESCRIPTION OF THE PREFERRED EMBODIMENT

Figure 4:
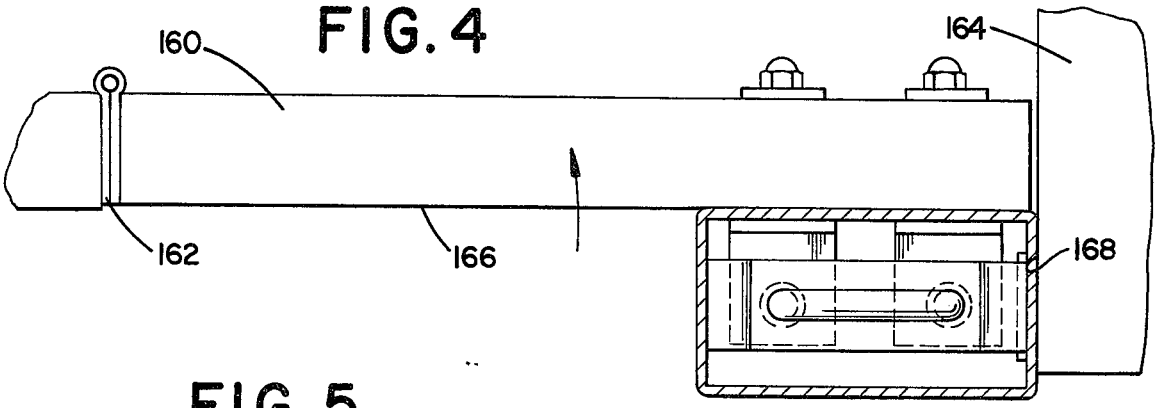
FIG. 4 is a top elevational view, partly in section, and showing a modification of applicant's lock assembly used in combination with a pair of planar surfaces.

A description of the preferred embodiment of applicant's invention will now be made with reference to FIGS. 1–3. Referring initially to FIG. 2 applicant's shielded cable lock assembly is comprised of housing 10, shackle 12, lock body 14 and cable 16. With reference to FIGS. 1 and 2 housing 10 will be seen to be defined by an upper wall 18 and side walls 20, 22, 24 and 26. As will be evident from FIG. 3 side walls 20, 22, 24 and 26 are defined by a single sheet of metal joined at seam 28. Upper wall 18 is, in turn, defined by a cap like element 30 which is received over the upper portions of the respective side walls 20, 22, 24 and 26 and welded in place.

It will be observed from FIGS. 1 and 2 that upper wall 18 and side walls 20, 22, 24 and 26 of the housing 10 define a closed generally cup shaped member with an access opening 32 being provided near the bottom of the housing.

A shackle hanger 34 supports shackle 12 interiorly of housing 10. In the preferred embodiment as shown in FIG. 2 applicant's shackle hanger is defined as a generally S-shaped element having an upper leg 36, an intermediate portion 38 and a lower leg 40. Lower leg 40 is welded to the interior surface of side wall 20. While in the preferred embodiment of FIG. 2 of the upper leg 36 is shown slightly spaced apart from the interior surface of side wall 24 it should be appreciated that leg 36 may be either welded to the interior surface of side wall 24 or, alternately, welded to the interior surface of upper wall 18.

A pair of openings 42, 44 are defined in shackle hanger 34 in order to receive shackle 12. The shackle is firmly held in place by means of welds 46. While it is not absolutely necessary to weld the shackle to the shackle hanger this has been found to be desirable since the placement of a weld serves to fix the shackle within the housing thus greatly facilitating the assembly of the shielded lock.

Lock body 14 is adapted to cooperate with shackle 12 in the manner shown in FIG. 2. It should be appreciated that the bottom surface 48 of lock body 14 is provided with a lock cylinder (not shown). By placing a key in the lock cylinder and turning same lock body 14 may be withdrawn from its associated shackle by pulling the lock body through access opening 32. The process is reversed in assembly.

The shackle and lock body of applicant's structure may take the form of a conventional padlock or a device specifically fabricated for applicant's shielded locking structure. Since the lock features of the lock body and shackle form no part of applicant's invention, a description of the interior elements of the lock body has been omitted from this specification.

Cable 16 as shown in FIG. 2 is provided with a pair of ends 50, 52 which are adapted to be received within housing 10. End 50 is affixed to an interior surface of side wall 20 of the housing by being crimped or otherwise secured to tubular end 54 of element 56. Element 56 is, in turn, welded to an interior surface of side wall 20.

End 52 of cable 16 is received within a generally tubular end 58 of generally L-shaped locking element 60. As shown in FIG. 2 locking element 60 includes a side leg portion 62 which is positioned essentially adjacent the interior surface of side wall 24 and an upper leg portion 64 which is positioned closely adjacent shackle hanger 34. Upper leg portion 64 is provided with a pair of openings 66, 68. When the locking element 60 is positioned as shown in FIG. 2 openings 66, 68 are approximately concentric with openings 42, 44 of shackle hanger 34 in order to receive shackle 12.

Applicant's shielded cable lock assembly as shown in FIG. 2 is advantageous in the securing of such property as bicycles, motorcycles, luggage, and other such items. It should be appreciated that in operation the embodiment of FIG. 2 simply requires the removal of lock body 14 and the disengagement of locking element 60 from shackle 12. This produces a free end of the cable 16 making it possible to thread the cable through a bicycle wheel, luggage handle or the like. Once the cable has been threaded as desired the locking element 60 is returned to the position as shown in FIG. 2 while lock body 14 is secured in place.

It should be appreciated from a study of FIG. 2 that applicant's shielded lock assembly leaves very little of the shackle or lock body exposed to the public. Similarly, very little of the respective cable ends 50, 52 are exposed. As a consequence it is difficult to cut, pry, or otherwise dislodge the cable from the shackle in order to remove the property secured thereby.

It should be appreciated that while in the embodiment of FIG. 2 cable end 50 is shown as being received within tubular end 54 of element 56 other means of securing the cable end to the housing should be within the spirit of the invention. Indeed the housing wall itself could be provided with means to receive the cable end in order to secure the cable thereto.

It has previously been noted that the upper leg 36 of shackle hanger 34 could, in a modified embodiment of FIG. 2, be welded or affixed to the interior surface of side wall 24. A still further modification of the shackle hanger is contemplated by applicant which is shown in FIG. 15. The upper wall of the housing, as shown in FIG. 15, can be provided with an inwardly stamped portion 70 which includes a pair of openings 72, 74 in order to receive shackle 12. A cover element 76 may then be employed to advantgeously overlie the shackle as by being welded in place as shown in FIG. 15.

FIG. 11 EMBODIMENT

Figure 11:
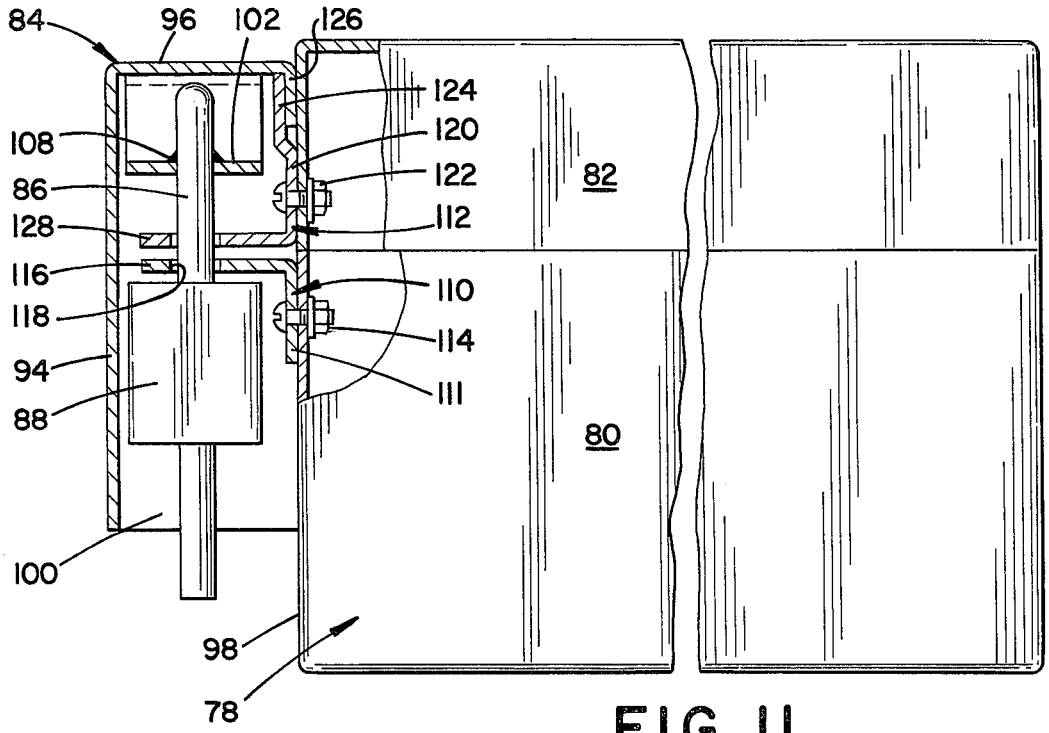
FIG. 11 is a side elevational view, partly in section, and showing a variation of applicant's invention as shown in FIG. 8 but with the lock body in an upright position.

Attention will now be directed to FIG. 11 wherein a modified form of applicant's invention is shown. More particularly FIG. 11 shows the use of applicant's shielded lock assembly in combination with a single planar surface such as defined by a box, cabinet or the like.

There is shown in FIG. 11 a box 78 which includes a main receptacle 80 and a cover 82. These elements may be hinged together (not shown) for the safekeeping of valuable property and the like. In order to provide for locking of box 78 it is necessary to prevent the lifting or removal of cover 82 from the main receptacle 80. To this end applicant provides a shielded lock assembly which includes as basic elements thereof a housing 84, shackle 86 and lock body 88. As shown more clearly in FIG. 13 housing 84 includes a pair of side walls 90, 92, an outer wall 94 and an upper wall 96.

As will be evident from FIG. 11 housing 84 is adapted to be positioned adjacent a planar surface 98 such that the side walls 90, 92, outer wall 94, and upper wall 96 cooperate with the planar surface to define a closed generally cup shaped enclosure with an access opening 100 located generally near the bottom of the enclosure.

Again referring to FIG. 11 a shackle 86 and lock body 88 are disposed within the enclosure. Shackle 86 is retained by means of shackle hanger 102 which is a generally U-shaped element having a pair of surfaces 104 welded to the interior surface of upper wall 96. As will be observed in FIG. 13 shackle hanger 102 is provided with a pair of openings 106 for the purpose of receiving shackle 86. The shackle is welded to the shackle hanger as shown in FIG. 11 at 108 in order to fix the shackle relative to the interior of the housing thus facilitating the assembly and disassembly of the locking device.

Figure 12:
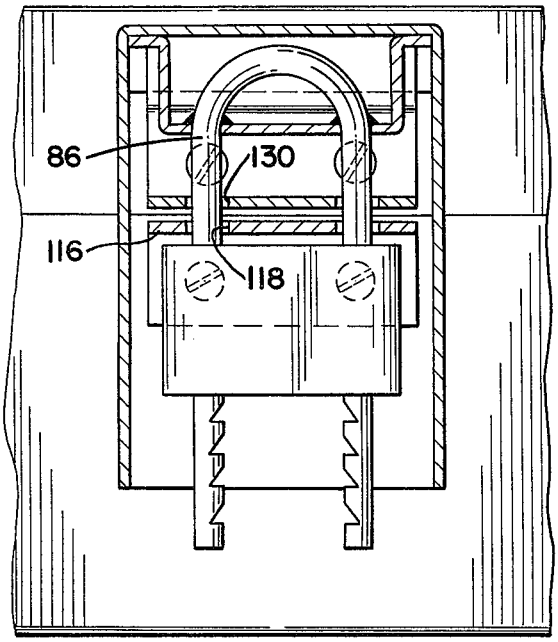
FIG. 12 is a front elevational view, partly in section, of the embodiment of FIG. 11.

A pair of locking staples 110, 112 extend from planar surface 98 into the enclosure defined by said surface and housing 84. Lower locking staple 110 is generally L-shaped having leg 111 affixed to main receptacle 80 by means of fasteners 114. Leg 116 projects radially outwardly from surface 98 and is provided with a pair of apertures 118 (as best seen in FIG. 12) in order to receive shackle 86.

Upper locking staple 112 has a leg portion 120 which is adapted to be secured to cover 82 by means of fasteners 122. A locking flange 124 projects radially outwardly from leg 120 (as shown in FIG. 11) for the purpose of receiving complementary locking flange 126 which is defined by upper wall 96 of housing 84. Locking flange 126 can be more clearly seen in FIG. 13.

Leg 128 of staple 112 projects radially outwardly from cover 82 and is provided with a pair of apertures 130 again for the purpose of receiving shackle 86. As will be evident from FIG. 12, apertures 118, 130 are very nearly in alignment in order to receive the shackle 86.

When applicant's locking structure as shown in FIG. 11 is assembled, it can be appreciated that movement of cover 82 relative to main receptacle 80 is impaired by interengagement of the locking staples 110, 112 with shackle 86 and lock body 88. The locking staples, shackle and shackle hanger are all advantageouesly received within housing 84 and are thus not accessible to the public. Interengaging locking flanges 124, 126 provide convenient retention means to secure the upper portion of the housing in engagement with the planar surface 98 defined by the main receptacle 80 and cover 82 in a manner so as to render more difficult the removal of the housing away from the planar surface as with a prying tool or the like.

When it is desired to open cover 82 relative to the main receptacle 80 lock body 88 is first removed from shackle 86 by inserting an appropriate key into the cylinder of the lock body and, after turning the key, causing the lock body to pass over the shackle in a downward direction as viewed in FIG. 11. After removal of the lock body, housing 84 (with shackle 86 welded therein at hanger 102) may be removed by exerting an upward or lifting force on the housing 84 (as viewed in FIG. 11) causing the shackle to clear the respective aligned apertures 118, 130.

FIG. 8 EMBODIMENT

Figure 10:
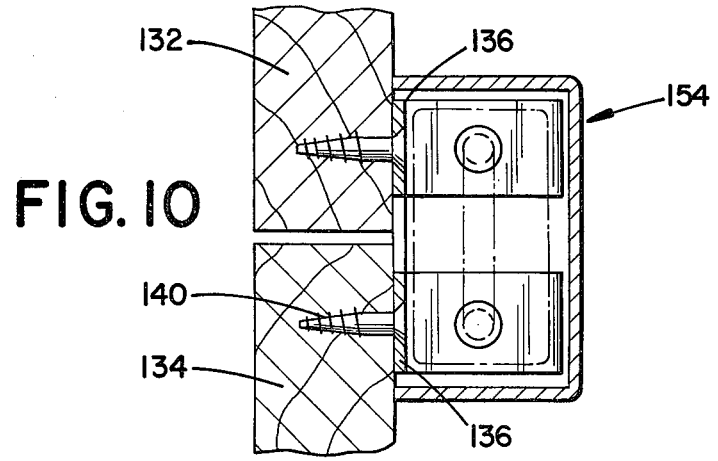
FIG. 10 is a cross-sectional view taken along the line 10—10 of FIG. 8.
Figure 8:
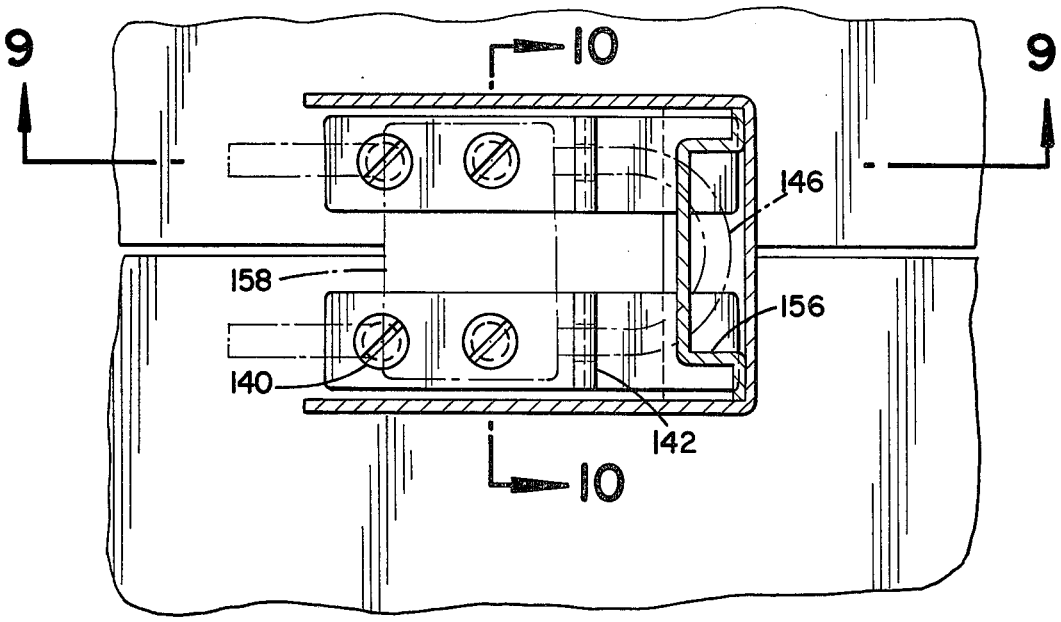
FIG. 8 is a side elevational view, partly in section, showing a further modified form of applicant's shielded lock assembly used in combination with a single planar surface.
Figure 9:
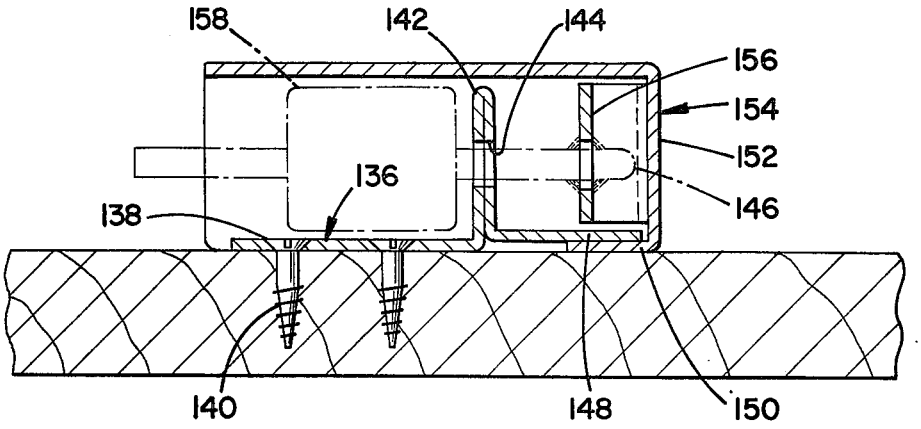
FIG. 9 is a cross-sectional view taken along the line 9—9 of FIG. 8.

An embodiment very similar to that of FIG. 11 is shown in FIGS. 8–10. In the embodiment of FIG. 8, however, the lock body is resting on its side as opposed to being in a vertical position as in FIG. 11. Also in FIGS. 8–10 the locking staples are slightly modified from that shown in FIG. 11.

In FIGS. 8–10 the shielded lock assembly is shown in combination with a planar surface such as defined by a pair of cabinet doors or the like. As shown in FIGS. 9 and 10 the doors 132, 134 are each provided with a locking staple 136. Locking staple 136 includes a leg portion 138 which is attached to the respective doors 132, 134 by means of fasteners 140. A radial shoulder 142 projects outwardly from leg 138 and is provided with an aperture 144 for the purpose of receiving shackle 146. A locking flange 148 is defined adjacent radial shoulder 142 and is adapted to cooperate with a complementary locking flange 150 which is defined by the upper wall 152 of housing 154. A shackle hanger 156 is secured to the internal wall surface of housing 154 in order to provide support for the shackle in the manner shown in FIGS. 8 and 9.

Figure 13:
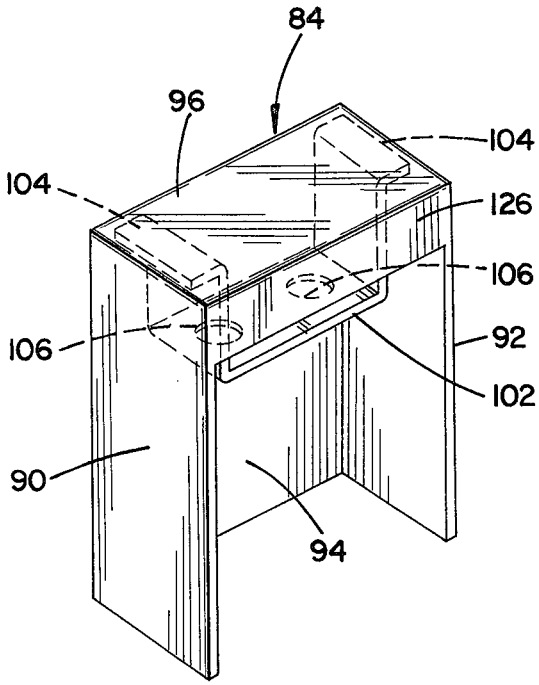
FIG. 13 is an elevational view, partly in phantom, and showing the housing of the embodiment of FIG. 11.

It will be apparent from a study of FIGS. 8–10 that the operation and structure of the shielded lock assembly is very similar to that shown and described in connection with the structure of FIGS. 11–13. That is to say, lock body 158 of FIGS. 8–10 cooperates with shackle 146 in order to provide for the retention of one locking staple 136 relative to the other locking staple 136. In this manner movement of door 132 relative to door 134 is prohibited. Housing 154 of the embodiment of FIGS. 8–10 is identical to housing 84 of FIG. 11 and functions to enclose or surround the respective locking elements of applicant's device in order to prevent the entry of a cutting or prying tool.

FIG. 4 EMBODIMENT

Attention will now be directed to FIGS. 4–7 wherein a still further embodiment of applicant's invention will be described. In the embodiment of FIGS. 4–7 applicant's shielded lock assembly is adapted to be used in combination with a pair of planar surfaces which are positioned approximately 90° to each other such as are defined by a door and jamb.

Referring first to FIG. 4 there is shown a door 160 including hinge 162 and jamb 164. A pair of intersecting planar surfaces 166, 168 are defined by door 160 and jamb 164.

Figure 7:
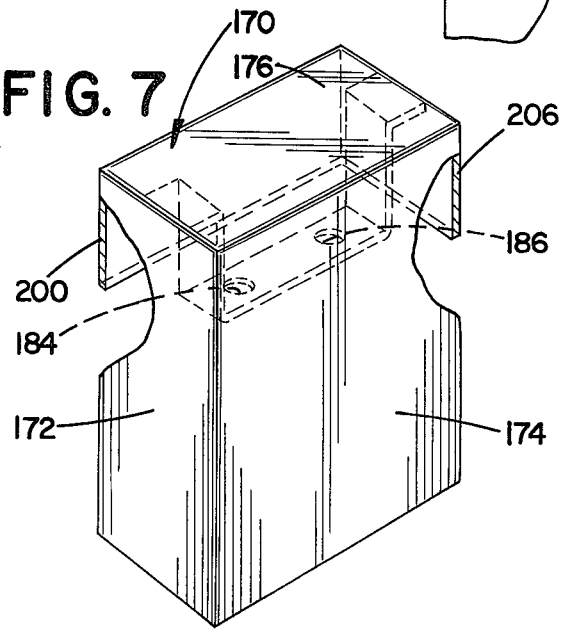
FIG. 7 is an elevational view, partly in section and partly in phantom, showing the housing of the embodiment of FIG. 4.

The housing of the embodiment of FIGS. 4–7 can best be seen in FIG. 7. Housing 170 includes a single side wall 172, an outer wall 174 and an upper wall 176. The side wall 172, outer wall 174 and upper wall 176 cooperate with planar surfaces 166, 168 to define a closed, generally cup shaped enclosure with an access opening 178 (FIG. 5) defined near the bottom of the enclosure.

A shackle 180 and lock body 182 are disposed within the enclosure. Shackle 180 is supported by shackle hanger 184 which includes a pair of apertures 186. Locking staples 188 are secured to door 160 by means of fasteners 190. Locking staples 188 include a leg 192 (FIG. 6) which receive fasteners 190, a generally radially projecting shoulder 194 and a locking flange 196. Shoulder 194 is provided with apertures 198 in order to receive shackle 180. Locking flange 196 of the staple is adapted to cooperate with a complementary locking flange 200 which is defined by upper wall 176 of housing 170. Locking flange 200 can best be seen in FIG. 7.

Attached to jamb 168 is a locking element 200 which is retained in place by means of fasteners 202. Locking element 200, as will be observed from FIG. 5, includes a locking flange 204 which is adapted to cooperate with a complementary locking flange 206 defined by the upper wall 176 of the housing.

Figure 5:
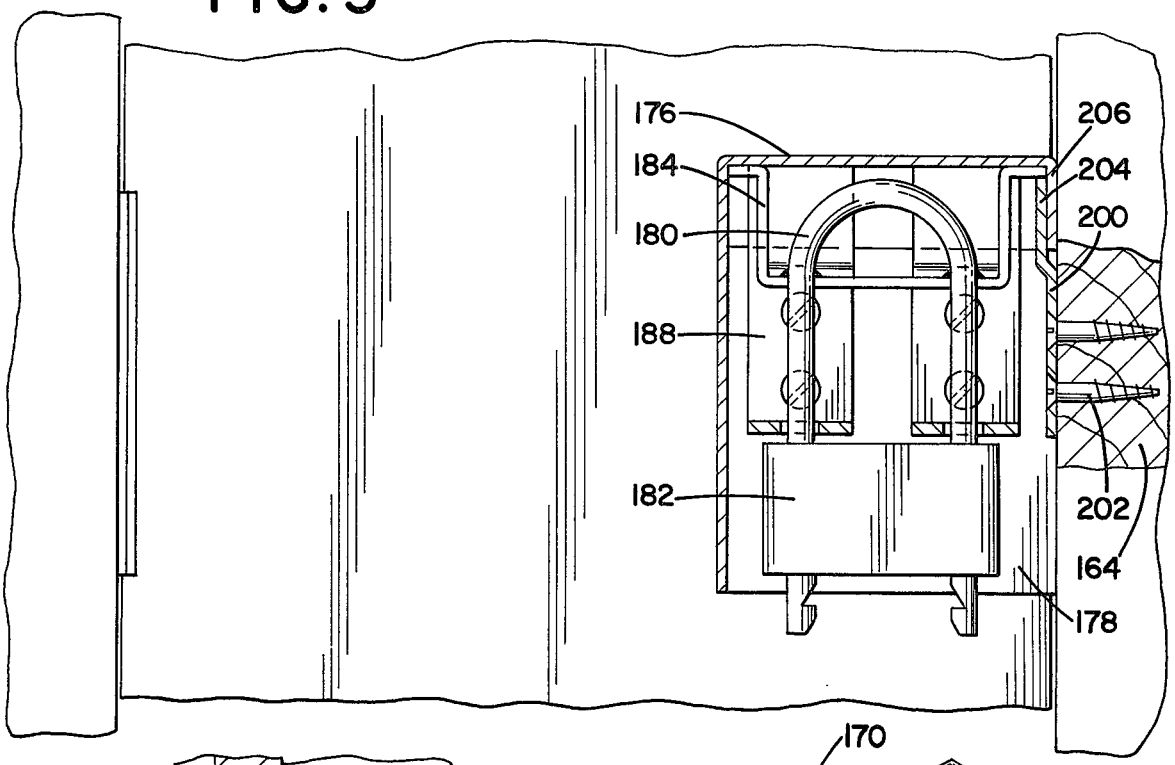
FIG. 5 is an elevational view, partly in section, showing the embodiment of FIG. 4 in front elevation.
Figure 6:
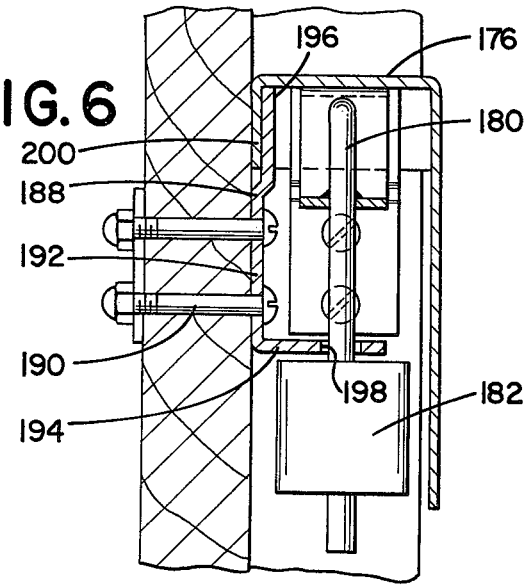
FIG. 6 is an elevational view, partly in section, showing the embodiment of FIG. 4 in side elevation.

It should be appreciated that with applicant's shielded lock assembly in place as shown in FIGS. 4 and 5 movement of door 160 relative to jamb 164 is inhibited.

It should be appreciated that in a modified form of the invention as shown in FIGS. 4–7 one of the locking staples 188 could be secured to the jamb 164 so that the shackle 180 would engage a locking staple attached to each of the elements (the door and the jamb) to be secured. The structure of FIGS. 4–7 has the advantage, however, of not having a locking staple secured to the jamb where it might tend to tear clothing or perhaps injure persons passing close to the jamb. The locking element 200 as shown in FIG. 5 has a relatively shallow profile with minimal protruding edges into the space immediately adjacent the jamb.

Earlier reference was made to the modified form of staple hanger as shown in FIG. 15 in connection with its use in the embodiment of FIG. 2. It should be appreciated that the modified form of hanger as shown in FIG. 15 is also applicable to the embodiment of FIGS. 4–7, the embodiment of FIGS. 8–10 and the embodiment of FIGS. 11–13.

What is claimed is:

1. A shielded lock assembly comprising in combination:

a housing having at least a single side wall, an outer wall, and an upper wall, said housing being adapted to be positioned adjacent a member such that said side wall, said outer wall and said upper wall cooperate with said member to define a closed generally cup-shaped enclosure with an access opening near the bottom of said enclosure;

at least one locking staple extending from said member into said enclosure;

a shackle and lock body disposed within said enclosure;

a shackle hanger supported interiorly of said enclosure, said shackle being held and retained within said enclosure by said hanger;

said locking staple engaging said shackle in a locked position;

retention means to secure the upper portion of said housing in engagement with said member in a manner so as to render more difficult the removal of said housing away from said member.

2. The invention of claim 1 in which said retention means is defined as interengaging flanges, one flange extending from said upper wall of said housing in engagement with the other flange extending from said planar surface.

3. The invention of claim 2 in which said other flange is defined by said locking staple.

4. A shielded lock assembly comprising in combination:

a housing having a single side wall, an outer wall, and an upper wall, said housing being adapted to be positioned adjacent first and second planar surfaces which are positioned approximately 90° to each other such that said side wall, said outer wall and said upper wall cooperate with said first and second planar surfaces to define a closed generally cup shaped enclosure with an access opening near the bottom of said enclosure;

at least one locking staple extending from said first planar surface into said enclosure;

a shackle and lock body disposed within said enclosure;

a shackle hanger supported interiorly of said enclosure, said shackle being held and retained within said enclosure by said hanger;

said locking staple engaging said shackle in a locked position;

a locking element secured to said second planar surface;

retention means to secure said housing to said locking element.

5. The invention of claim 4 in which further retention means are provided to secure the upper portion of said housing in engagement with said first planar surface in a manner so as to render more difficult the removal of said housing away from said planar surface.

6. The invention of claim 4 in which said retention means is defined as complementary locking flange defined by said locking element and said housing.

* * * * *